United States Patent [19]

Iwasaki

[11] Patent Number: 4,948,635

[45] **Date of Patent: * Aug. 14, 1990**

[54] GRAVURE COATING DEVICE AND METHOD

[75] Inventor: Takashi Iwasaki, Samukawa, Japan

[73] Assignee: Yasui Seiki Co., Ltd., Tokyo, Japan

[ * ] Notice: The portion of the term of this patent subsequent to Dec. 20, 2005 has been disclaimed.

[21] Appl. No.: 285,831

[22] Filed: Dec. 16, 1988

Related U.S. Application Data

[63] Continuation-in-part of Ser. No. 895,304, Aug. 11, 1986, Pat. No. 4,791,881.

[30] Foreign Application Priority Data

Sep. 6, 1985 [JP] Japan ..... 136404

[51] Int. Cl.[5] ..... B05C 1/08

[52] U.S. Cl. ..... 427/345; 427/346; 427/355; 427/359; 427/369; 118/212; 118/235; 118/244; 118/259

[58] Field of Search ..... 118/244, 212, 235, 259; 427/345, 346, 355, 359, 367

[56] References Cited

U.S. PATENT DOCUMENTS

| | | | |
|---|---|---|---|
| 1,793,082 | 2/1931 | Goss | 118/212 |
| 2,218,249 | 10/1940 | Nadeau | 118/212 |
| 2,396,946 | 3/1946 | Grupe | 118/212 |
| 2,641,219 | 6/1953 | Tranter | 118/244 |
| 2,787,244 | 4/1957 | Hickin | 118/259 |
| 2,918,393 | 12/1959 | Wommack | 118/259 |
| 3,177,847 | 4/1965 | Schnierlein | 118/259 |
| 3,630,853 | 12/1971 | Busch | 118/212 |
| 4,128,077 | 12/1978 | Meier | 118/202 |
| 4,241,690 | 12/1980 | Muller | 118/244 |
| 4,791,881 | 12/1988 | Iwasaki | 118/244 |

FOREIGN PATENT DOCUMENTS

| | | |
|---|---|---|
| 2237556 | 8/1971 | Fed. Rep. of Germany . |
| 2526390 | 5/1976 | Fed. Rep. of Germany . |
| 7723027 | 1/1977 | France . |
| 2503373 | 4/1973 | Japan . |
| 4903778 | 5/1978 | Japan . |
| 4194579 | 4/1979 | Japan . |
| 4581283 | 10/1983 | Japan . |
| 22345983 | 12/1983 | Japan . |
| 1017640 | 1/1966 | United Kingdom . |
| 1804370 | 1/1972 | United Kingdom . |
| 1349173 | 3/1974 | United Kingdom . |

OTHER PUBLICATIONS

Handbook on Gravure Printing, Publication date Jul. 25, 1981, Editor: Masayoshi Araki, Publisher: Kakou Gijutsu Kenkyujs, title page, pp. 463, 464, abstract page and English translation of p. 463.

*Primary Examiner*—Jay H. Woo
*Assistant Examiner*—Jeremiah F. Durkin, II

[57] ABSTRACT

A gravure coating device and method for applying a coating to a first side of a traveling continuous web. A pair of spaced rollers support the web on the second side while a gravure roller located between the rollers tangentially contacts the first side of the web. A doctor blade is utilized to remove excess coating from the gravure roller while a nozzle is utilized to apply the coating material to the gravure roller.

15 Claims, 5 Drawing Sheets

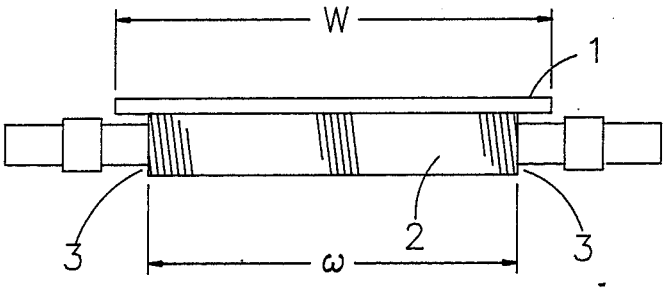
FIG. 1 -- PRIOR ART
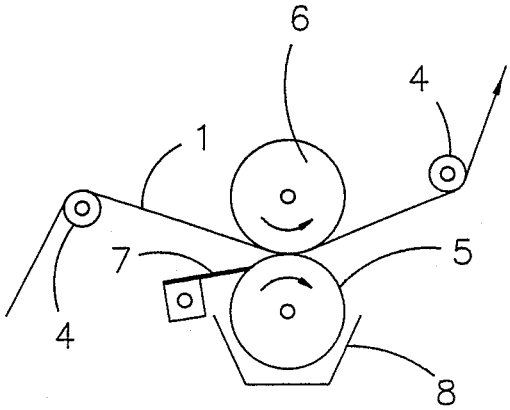
FIG. 2 -- PRIOR ART

--PRIOR ART

GRAVURE COATING DEVICE AND METHOD

CROSS REFERENCE TO RELATED PATENT APPLICATION

This is a continuation-in-part of pending U.S. patent application Ser. No. 895,304, filed 8/11/86, now U.S. Pat. No. 4,791,881 issued Dec. 20, 1988 in the name of Takashi Iwasaki and assigned to Yasui Seiki Co., Ltd.

FIELD OF THE INVENTION

This invention relates to coating thin webs with gravure coatings.

DESCRIPTION OF THE DRAWINGS

FIG. 1 is a front view of a prior art gravure coating device.

FIG. 2 is a side view of a prior art gravure coating device.

FIGS. *6a* and *6b* are respective schematic representations of webs being coated using a conventional gravure roll and a gravure roll in accordance with the invention.

FIGS. *7a* and *7b* depict unacceptable coatings on webs, typical of results produced using prior art devices.

Figure 8:
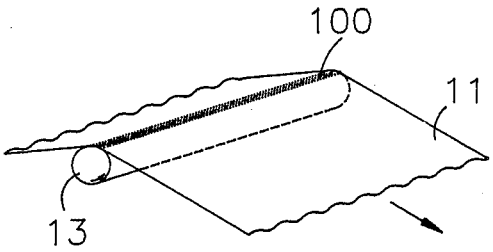

FIG. 8 is a schematic perspective representation of a gravure roll coating a web according to the invention.

Figure 9:
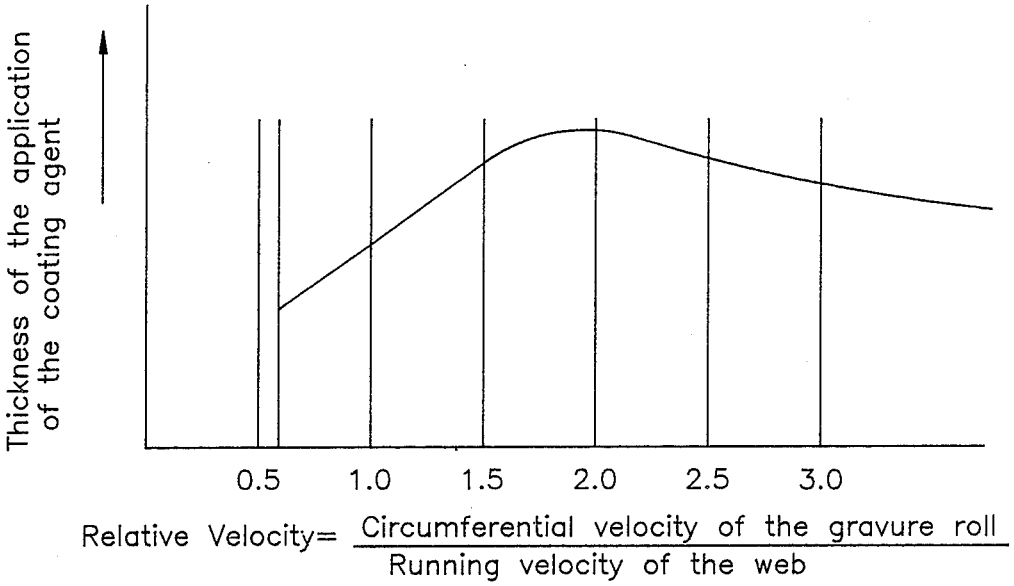

FIG. 9 is a plot of thickness of coating applied to the web versus ratio of gravure roll circumferential velocity to web running velocity.

BACKGROUND OF THE INVENTION

When applying a liquid or viscous coating, whether diluted or non-diluted, to one surface of a plastic film, paper or cloth web, the coating material tends to escape from the surface being coated, by migrating around the web edge to the opposite surface of the web. This coating migration to the opposite surface of the web is undesirable and must be prevented for a uniform thickness coating to result on the surface of the web.

Heretofore, because of the coating migration problem, when seeking to apply coatings to a single side of a web, coatings have been successfully applied only to web surface portions narrower than overall width of the web, leaving uncoated zones adjacent to the web coated surface, at the web edges.

DESCRIPTION OF THE PRIOR ART

In the prior art as shown in FIG. 1, when coating a web 1 with a roller 2, reduced-diameter steps 3 are provided at both ends of roller 2 so that width w of the engraved portion of roller 2, via which the coating is applied, is narrower than overall width W of web 1. When web 1 is sufficiently thick, no problem arises with roller 2 and steps 3. But when web 1 is thin, for example from about 2 to about 9 microns in thickness, longitudinal coating wrinkles result on the web surface coated via contact with the portion of roller 2 inboard of steps 3; these longitudinal wrinkles are not acceptable.

In prior art gravure coating devices of the type shown in FIG. 2, when coating is applied to a thin web, longitudinal coating wrinkles typically result on the web surface. In these prior art devices, coating material applied to gravure roll 5, by roll 5 rotating through coating material in reservoir 8, with excess coating being wiped from roll 5 by doctor blade 7, is transferred to the underside of a web 1, which is longitudinally extended by extension rolls 4 and clamped between gravure roll 5 and rubber roll 6. When web 1 is thin, longitudinal wrinkles are produced on the surface of web 1 from clamping force applied by rolls 5 and 6.

In such conventional gravure printing, to produce good printing results, both a clamping roll and an impression gravure roll are usually required.

Respecting the printed prior art, Japanese utility model publication No. 45,812/83 discloses a roll applying a coating to a web and moving in a direction opposite that of web travel. '812 indicates the need for an intermediate roller to press the coating into the web and for nip rollers downstream of the coating application roller to remove excess coating material from the web surface.

Japanese laid-open patent publication No. 25,033/73 discloses a roll applying a coating to a web and moving opposite to the web at the point of roll-web contact. '033 further discloses guide rollers 8, 9 on either side of the coating application roll, with guide rollers 8, 9 being movable responsively to characteristics of the web optically sensed by sensor 13. '033 also discloses the need for another roll downstream of the coating application roll to press the coating against the web.

Japanese laid-open patent publication No. 223,459/83 shows a smoother device downstream of a coating application roll. This smoother is illustrated as item 5 in FIG. 1 of '459; a similar device appears as 36 in FIG. 3.

Japanese patent publication No. 53-49037 discloses apparatus for applying coating material to a moving web where the apparatus includes a coating application roll rotating in a bath of a coating material in an open-top reservoir at ambient pressure. The web, after contacting the roll, passes over a nozzle through which gas is expelled against web surface which has contacted the roll.

Japanese patent publication No. 54-41945 discloses apparatus for applying coating material to a moving web including a roll rotating in coating material and contacting the bottom of a moving web to apply viscous coating material to the web. Associated with but slightly displaced from the coating application roll is another roll which maintains the web in desired geometric configuration as the web leaves the first roll with coating applied.

United Kingdom specification No. 18043/70 discloses a roller, rotating within a bath of heat sealing material which is capable of heat sealing a web, contacting the moving web to apply the heat sealing material to the web. The web and roller contacting surfaces move in the same direction.

German Offenlegungschrift No. 2,526,390 discloses a roll for applying coating material to the underside of a moving web where the roll is within a housing with coating material applied via a chamber in the housing. A pair of doctor blades closely spaced from the roll help to maintain the coating material within the housing as the roll rotates.

United Kingdom specification No. 1,017,640 discloses a roller having a moving web in contact therewith and a stationary impression pad applying pressure to the web as it passes over the roller.

French patent publication No. 77-23027 corresponds to Japanese publication No. 53-49037.

German Offenlegungschrift No. 2,237,556 discloses apparatus similar to that disclosed in No. 2,526,390, with a roll contacting a web where coating material is applied to the roll from below. '556 discloses the web passing around the roll between the roll and the coating material supply and also discloses a roll rotating in a bath of coating material with a doctor blade to regulate coating thickness on the roll.

U.S. Pat. No. 3,177,847 discloses apparatus for applying an organic liquid coating material to a moving web with the apparatus including a roll, a doctor blade and a metering device for supplying the liquid organic coating to the roll.

The same problem as noted above under the heading "Background of the Invention" is encountered with gravure coating devices of the type shown in FIG. 1 of U.S. Pat. No. 4,438,695 and FIG. 1 of U.S. Pat. No. 4,474,110. The *Handbook on Gravure Printing*, published July 25, 1981 by Kakou Gijutsu Kenkyujo, teaches that gravure rolls typically have diameters from 100 to 150 millimeters. The clamping roll and the impression gravure roll, which are usually required as noted above under the heading "Background of the Invention", typically have diameters of at least 120 millimeters, as described in Section "4-2-1 Printing Pressure," FIG. 4–13 and Table 4-3 on pages 463 and 464 of the *Handbook on Gravure Printing.*

SUMMARY OF THE INVENTION

This invention provides apparatus and methods for applying a gravure coating to a thin web without producing longitudinal wrinkles. The coating can be a multi-color coating. The invention not only produces a smooth coating on a thin web, it also allows precise control of thickness of the coating layer on the web.

In one aspect of the invention, coating material is transferred from a gravure roll to the underside of a moving continuous web where the web upper surface is free. A doctor blade wipes excess coating material from the gravure roll surface immediately before the coating material is applied to the web undersurface. The coating material is applied by the gravure roll to the web underside where the web upper surface is free so that no matter how thin the web, the coating can be applied without producing longitudinal coating wrinkles on the web coated surface.

In another aspect of the invention, a plurality of sets of gravure rolls, doctor blades and coating supply devices are positioned to be moved to and from the web undersurface, independently of each other. Different color coatings are supplied to the respective sets of rolls, blades and coating supply devices so that multicolor coatings can be applied to a thin web without producing longitudinal coating wrinkles.

The gravure roll(s) can be rotated in the same direction as the thin web or in the opposite direction from the thin web. The gravure roll peripheral velocity is variable so that coating smoothness as well as coating thickness on the web can be easily adjusted, according to the purpose for which the coating is applied.

The web is not clamped between a pair of rolls. The web contacts only the gravure roll, so that even when the web is relatively thin, satisfactory coating, without longitudinal wrinkles, results.

DESCRIPTION OF THE PREFERRED EMBODIMENTS

Figure 3:
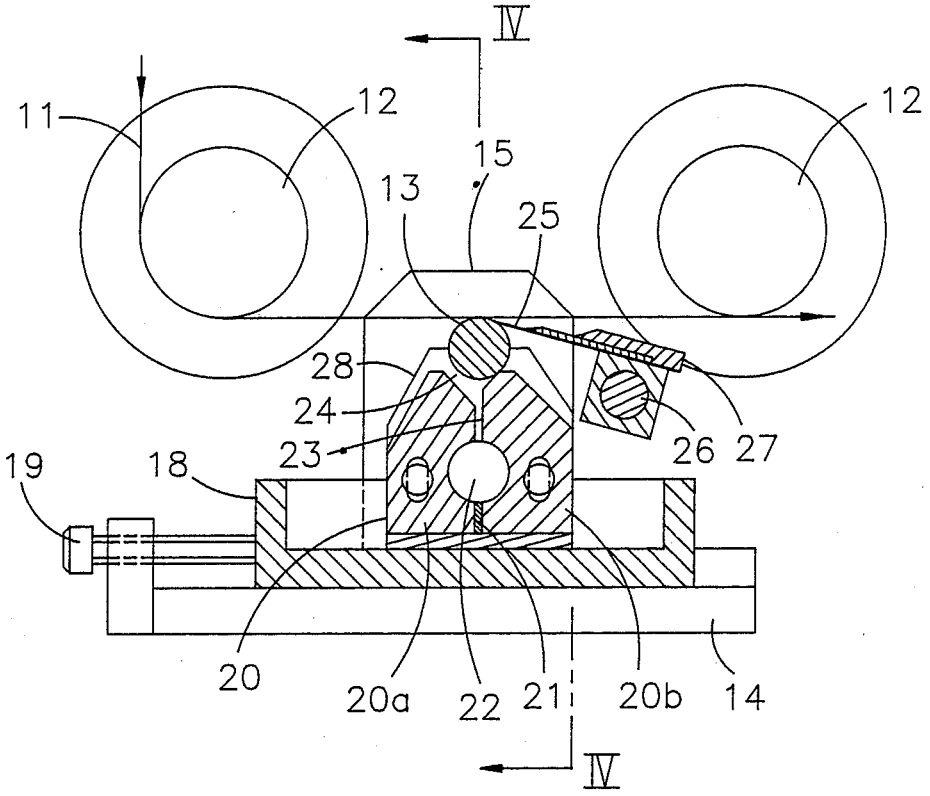
FIG. 3 is a longitudinal sectional view of a gravure coating device of the invention.
Figure 4:
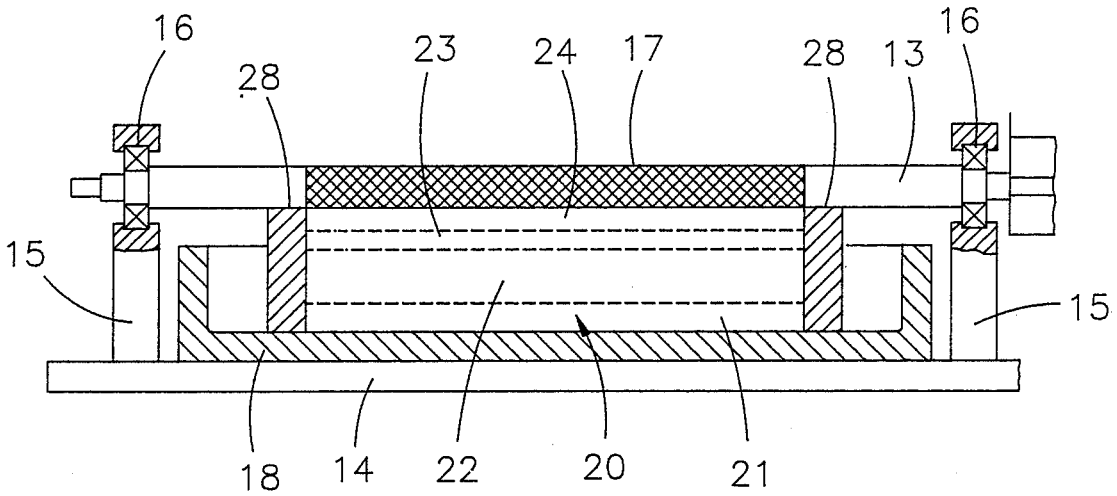
FIG. 4 is a sectional view taken along IV—IV in FIG. 3.

FIGS. 3 and 4 show a preferred embodiment of the invention. A continuous web 11 is transported from left to right in FIG. 3. Web 11 is unwound from a supply roll (not shown) and is maintained in tension by extension rolls 12 as shown in FIG. 3. Finally, web 11 is taken up by a take-up roll (not shown).

A gravure roll 13 having relatively small diameter, for example 20 millimeters, is below web 11 and between extension rolls 12. Gravure roll 13 is rotatably supported by bearings 16 at its ends, which bearings are mounted on a pair of support members 15 extending upwardly from a base 14. Base 14 together with the structure mounted on base 14, including gravure roll 13, is vertically movable by a suitable driving mechanism (not shown). Rotary motion from a driving motor (not shown) is transmitted through a coupling (not shown) to rotate gravure roll 13. In this embodiment, gravure roll 13 rotates in the direction opposite direction of transport of web 11, i.e. in the counterclockwise direction in FIG. 3.

An engraved pattern 17 formed on the outer cylindrical surface of gravure roll 13 is narrower in width, measured in the axial direction, than gravure roll 13. A coating overflow reservoir 18 rests on base 14, below gravure roll 13, and is held in position by bolt 19 urging reservoir 18 against stop block 50 of base 14. Coating supply nozzle 20, furnishing coating material to gravure roll 13, is mounted in coating overflow reservoir 18 and has length equal to axial length of engraved portion 17 of gravure roll 13, as shown in FIG. 4. (Supply nozzle "length" is measured in a direction transverse to the longitudinal direction of the web and parallel with the axis of rotation of gravure roll 13.)

As shown in FIG. 3, supply nozzle 20 includes a pair of nozzle pieces **20*a* and 20*b*, with a thin insert 21 interposed between the lower portions of nozzle pieces 20*a* and 20*b*. Coating reservoir 22, which is circular in cross section and located above insert 21, extends lengthwise of supply nozzle 20 and receives coating material supplied from outside the apparatus of the invention. Absence of an insert between nozzle pieces 20*a* and 20*b*, above reservoir 22, defines an elongated coating communication channel 23**.

An axially elongated nozzle orifice 24 is at the upper end of supply nozzle 20 so that coating supplied from reservoir 22 through channel 23 may be temporarily stored in nozzle orifice 24 and then be applied to engraved portion 17 of gravure roll 13. Length of nozzle orifice 24 preferably at least equals axial length of engraved portion 17 of gravure roll 13. Plug members 28 define the ends of supply nozzle 20. Plug members 28 may be used with nozzle pieces **20*a*, 20*b* and insert 21** of different lengths to define different lengths for the nozzle orifice. This may be desirable, depending on the width of the web to be coated, the coating material, etc.

Doctor blade 25 contacts gravure roll 13 and wipes excess coating from engraved portion 17 immediately before engraved portion 17 applies coating material received from nozzle orifice 24 to the undersurface of web 11. Doctor blade 25 is attached to holder 27, which in turn is pivotally carried by shaft 26 extending parallel to gravure roll 13. Doctor blade 25 regulates the amount of coating carried by engraved portion 17 over the entire axial length thereof and wipes coating from the portions of gravure roll 13 extending outwardly beyond engraved portion 17.

Web 11 moves at a predetermined velocity from left to right in FIG. 3. Coating material is fed from reservoir 22 through communication groove 23 into orifice 24 of supply nozzle 20 while gravure roll 13 is rotating counterclockwise. The lower portion of engraved portion 17 of gravure roll 13 rotates through coating material in nozzle orifice 24 so that coating material is applied to the surface of engraved portion 17 and is carried to doctor blade 25 as gravure roll 13 rotates. It is preferable that the quantity of coating material fed to nozzle orifice 24 be equal to or slightly greater than the quantity of coating material adhering to engraved portion 17 as gravure roll 13 passes through orifice 24.

Any excess coating material applied to engraved portion 17 is wiped off by doctor blade 25 so that a suitable quantity of coating material remains on the surface of engraved portion 17 across its entire width. Excess coating wiped off of one part of engraved portion 17 by doctor blade 25 may flow along doctor blade 25 and applied to another part of engraved portion 17 by doctor blade 25, or may flow over the outer surface 29 of supply nozzle 20 into overflow reservoir 18 and from there again be supplied to reservoir 22. Once a suitable quantity of coating material has been so-applied to engraved portion 17 of gravure roll 13, gravure roll 13, base 14 and the associated structure are raised unitarily so that engraved portion 17 of gravure roll 13 contacts the undersurface of web 11 and coating material on engraved portion 17 is transferred to the undersurface of web 11.

Direction of travel of web 11 and direction of rotation of engraved portion 17 are, especially when the coating is highly viscous, preferably opposite each other at the area of contact therebetween; thus engraved portion 17 slidingly contacts the undersurface of web 11. As a result, the coating material on engraved portion 17 which is transferred to the undersurface of web 11 is initially applied with a sliding motion relative to web 11, in a direction opposite the direction of travel of web 11. This initial application of the coating material by sliding motion caused by opposite rotation of gravure roll 13 relative to the web, results in the coating material being uniformly and smoothly applied to the undersurface of web 11, producing a smooth, uniform thickness coating on web 11.

Smoothness of the coating on web 11 is adjusted by varying the relative velocity difference between web 11 and gravure roll 13. No separate coating smoothing device is needed. In addition, no working rubber roll need be positioned in opposed relationship with gravure roll 13, contacting web 11 on the side opposite that contacted by gravure roll 13. Even when web 11 is relatively thin, no longitudinal coating wrinkles are produced on web 11; coating material is applied to the undersurface of web 11 in a very satisfactory manner.

Compared with a conventional gravure roll having a large area of contact with the web, in the invention the area of contact between gravure roll 13 and the undersurface of web 11 is extremely small. The small diameter of gravure roll 13 facilitates gravure roll-web contact and separation of web 11 from gravure roll 13. As a result, the positions on web 11 at which the coating starts and stops can be precisely controlled. Furthermore, gravure roll cost is reduced; the gravure coating device is compact and lightweight.

In FIG. 3, gravure roll 13 rotates so that the surface of gravure roll 13 contacting web 11 moves opposite the direction of movement of web 11. While this is the preferred embodiment of the invention, gravure roll 13 may also be rotated in the opposite, clockwise direction, so that the surface of gravure roll 13 contacting web 11 moves in the same direction as web 11. In such case, doctor blade 25 is at the opposite position with respect to gravure roll 13, so that doctor blade 25 contacts gravure roll 13 after gravure roll 13 picks up coating material in nozzle orifice 24 but before gravure roll 13 contacts web 11. When gravure roll 13 rotates in the clockwise direction at a speed so that there is a relative velocity difference between web 11 and gravure roll 13, coating material is also smoothly applied to the undersurface of web 11. Using this configuration of the invention, when peripheral velocity of gravure roll 13 is faster than speed of travel of web 11, especially when peripheral velocity of gravure roll 13 is at least about twice as fast as speed of travel of web 11, smoothness of the coating applied on the undersurface of web 11 is enhanced relative to prior art techniques.

The direction of rotation of gravure roll 13 depends on the viscosity of the coating material. When coating material viscosity is high, gravure roll 13 should preferably be rotated in the counterclockwise direction in FIG. 3 so that the surface of gravure roll 13 contacting web 11 moves opposite to the direction of movement of web 11. When coating material viscosity is low, gravure roll 13 should be rotated clockwise in FIG. 3 so that the surface of gravure roll 13 contacting web 11 moves in the same direction as web 11. Using these techniques, coating applied to the undersurface of web 11 is satisfactorily smooth. By varying rotational speed of gravure roll 13 to change the relative velocity between web 11 and gravure roll 13, smoothness of coating applied to the undersurface of web 11 may be assured and coating thickness can be adjusted and even controlled to a predetermined value.

Using a plurality of gravure coating devices of the type shown in FIGS. 3 and 4, a web 11 can be transported through the gravure coating devices and coating materials of different colors can be supplied to coat respective portions of the web with coating materials of different colors. An example, blue, red and yellow coatings may be fed to three serially disposed gravure coating devices of the type illustrated in FIGS. 3 and 4. The respective gravure coating devices are maintained below and out of contact with web 11, until a selected portion of undersurface of web 11, which must be coated with a specific color, approaches the gravure coating devices. When the selected portion of the web reaches the gravure coating device having coating material of the desired color, that gravure coating device is raised so that the engraved portion of its gravure roll contacts the undersurface of web 11. In this way, a coating of various colors can be applied to the undersurface of web 11.

Even after long periods of no operation, a suitable predetermined quantity of coating material can be provided to engraved portion 17 and controlled by doctor blade 25 when the coating operation begins. Prior art multi-color gravure coating devices typically clamp the web between two nip rolls, defined by a gravure roll 5 and a pressure roll 6 as shown in FIG. 2. However, when a thin web is clamped between two nip rolls 5, 6 as in FIG. 2, longitudinal wrinkles result on the surface of the thin web, making it difficult to coat the web satisfactorily. Additionally, the two nip rolls 5 and 6, one of which is the gravure roll, must be movable towards and away from each other; hence the prior art gravure devices are large, complex in construction and expensive to manufacture.

On the other hand, the gravure coating device capable of multi-color coating according to the invention is simple, compact and inexpensive to manufacture. Required installation space and costs are $\frac{1}{8}$ to $\frac{1}{3}$ of prior art gravure coating devices.

Figure 5:
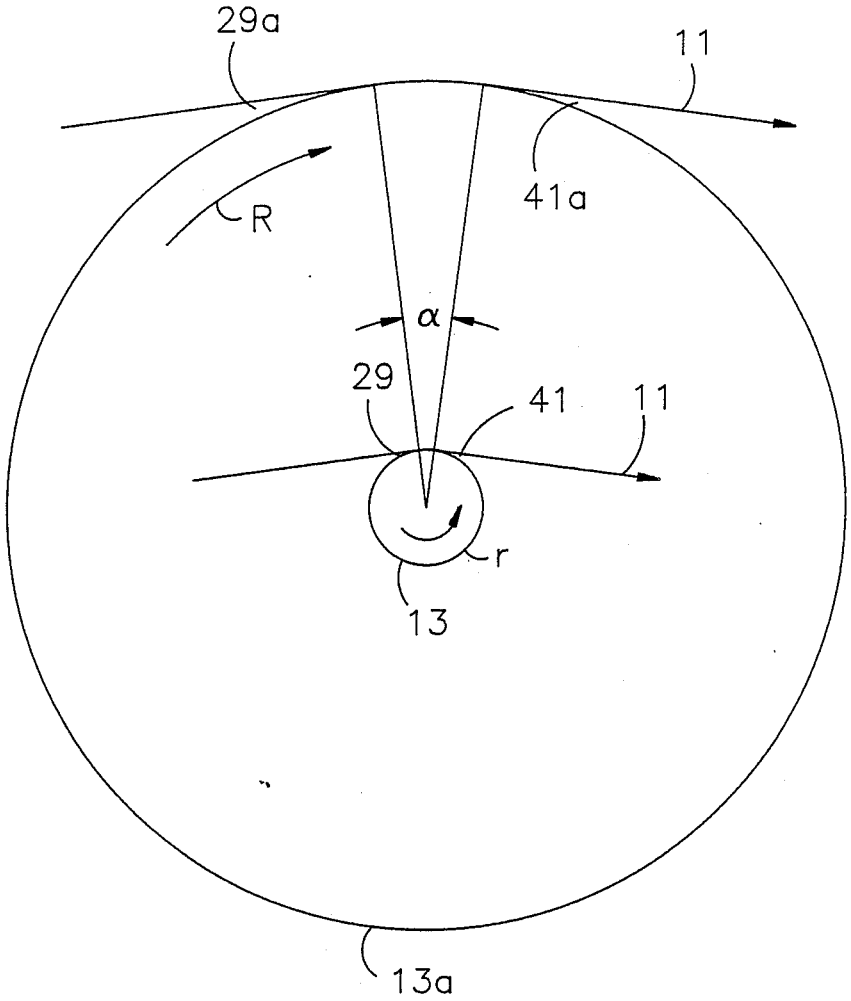
FIG. 5 is a schematic comparison in cross-section of a conventional gravure roll and a gravure roll of the invention, both contacting a web.

FIG. 5 illustrates gravure roll-web contact geometry, contrasting gravure roll-web contact provided by the invention with gravure roll-web contact in conventional gravure coating and printing devices. In FIG. 5, 13 is the gravure roll of the invention, while 13*a* is a conventional gravure roll. 11 is a moving web coated by gravure roll 13, while 29 and 41 are wedge-shaped spaces between gravure roll 13 and web 11, where web 11 first moves towards gravure roll 13 and then moves away from gravure roll 13 after contact therewith. 29*a* and 41*a* are similar wedge-shaped spaces between a conventional gravure roll 13*a* and a web 11*a*. In FIG. 5, the angle subtended by the portion of web 11 riding on a segment of the circular periphery of the gravure roll(s) is denoted alpha and indicated as typically being about 15 degrees; angle alpha defines pie-shaped sectors of the cross-sections of the gravure rolls.

In the preferred embodiment and practice of the invention as shown schematically in FIG. 5, gravure roll 13 applies coating material to the underside of web 11 at a position where web 11 has a free upper side. The gravure roll surface contacting the web most preferably moves in a direction opposite to that of the web, especially when viscous coating material is being applied. Gravure roll 13 preferably has a relatively small diameter, preferably from about 20 millimeters to about 50 millimeters, most preferably about 20 millimeters. This small gravure roll diameter, coupled with movement of the gravure roll surface in a direction opposite that of the web, provides superior coating performance relative to prior art devices.

The small diameter, in the preferred 20 millimeters to 50 millimeters range, of the gravure roll 13 of this invention is in sharp contrast to conventional prior art gravure rolls having large diameters.

The invention applies a gravure coating to a moving web, producing a smooth, uniform coating of quality that prior art devices cannot achieve.

FIG. 5 illustrates the situation when a small diameter gravure roll 13 (as per the invention) and a large diameter gravure roll 13*a* (typical of the prior art) are brought into contact with the underside of web 11 over an equal contact angle alpha. The contact angle is defined by the arc subtended by the length of web-gravure roll overlay along the curved surface of the gravure roll. For a given contact angle alpha, a small gravure roll 13 (as per the invention) overlays and, if no coating material is present between the gravure roll and the web, contacts web 11 over a shorter distance measured along the gravure roll curved surface than does a conventional large diameter gravure roll 13*a*. Accordingly, small gravure roll 13 "contacts" web 11 over a smaller area of the web than does a conventional gravure roll 13*a*. Surprisingly, the smaller web-gravure roll circumferential "contact" distance and corresponding smaller web-gravure roll "contact" area results in good gravure coating—far superior to results achieved using conventional, large size gravure rolls.

Using a microscope and observing "contact" of gravure rolls 13 and 13*a* with web 11 in the region that web is overlaps gravure roll 13 reveals a difference in the nature of web-gravure roll "contact", depending on whether a large conventional gravure roll 13*a* or a small gravure roll 13 (as per the invention, preferably rotating in the direction shown by arrow r) is used.

Still referring to FIG. 5, whether using a conventional large gravure roll 13*a* rotating in the direction shown by arrow R or a small gravure roll 13 as per the invention, when web 11 is running at normal speed, a thin layer of coating material forms between the engraved portion of the gravure roll and web 11 and extends along the web in both the upstream and downstream directions. The thin layer of coating material extends along the web from either extremity of the area of web-gravure roll "contact", which defines contact angle alpha. Specifically, the thin layer of coating material forms over a distance, measured along the gravure roll curved surface and along the web, equal to (1) circumferential length of gravure roll-web overlap or "contact" defining central angle alpha plus (2) respective lengths defined by wedge-shaped spaces or pockets 29, 41 and 29*a*, 41*a*, which are regions of convergence and divergence of web 11 respecting the gravure roll 13 or 13*a*, on either side of the region of gravure roll-web overlay or "contact". These wedge-shaped spaces 29, 41 and 29*a*, 41*a* fill with coating material; the extent to which the coating material fills the regions of convergence and divergence between the web and the gravure roll defines the length of wedge-shaped spaces 29, 41 and 29*a*, 41*a*. The lengths of wedge-shaped spaces 29, 41 and 29*a*, 41*a* along the gravure roll and web 11 may vary for a given web material, gravure roll pattern, gravure roll material, web speed, coating material viscosity or other parameter and may be different on either side of the area of web-gravure roll overlap. The coating material applied to web 11 comes from the thin layer of coating material lying along the portion of the gravure roll engraved surface defined by contact angle alpha and from the two wedge-shaped spaces 29, 41 or 29*a*, 41*a* respectively.

Figure 6A:
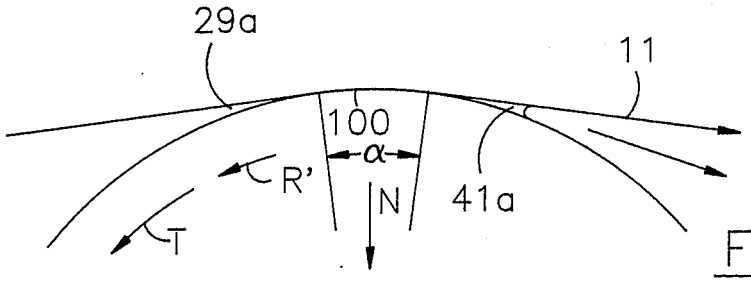
Figure 6B:
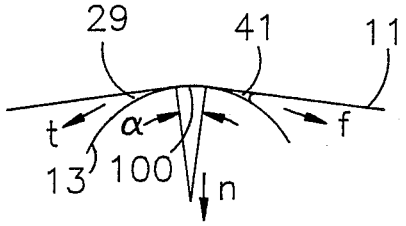

In the prior art as shown in FIG. 6*a*, if conventional large diameter gravure roll 13*a* were rotated to move its surface in a direction opposite to the running direction of web 11 at the position of gravure roll-web contact as indicated by arrow R′ (which is precisely how the small gravure roll in the invention preferably rotates), frictional force represented by vector F in FIG. 6*a*, generated between conventional gravure roll 13*a* and web 11, would become very large due to the large area of gravure roll-web contact. To run web 11 smoothly against this large frictional force, it would be necessary to apply a very high tension force, represented by arrow T, to web 11 to overcome the frictional force. Were a large tension force T applied to web 11, a component of tension force T would act on roll 13*a* in a direction essentially normal to the surface of conventional gravure roll 13*a*, towards the center of gravure roll 13*a*. This normal component of tension force T is indicated by arrow N in FIG. 6*a* and would hold web 11 tightly against the curved surface of conventional gravure roll 13*a*.

Such tight contact of web 11 against conventional gravure roll 13*a* squeezes the thin layer of coating material—indicated by numeral 100 in FIGS. 6, 7 and 8 and by diagonal cross-hatching in FIGS. 7 and 8—out from between web 11 and conventional gravure roll 13*a*. As a result, web 11 contacts conventional gravure roll 13*a* over at least the central portion of the gravure roll surface subtended by contact angle alpha; in this area there is no coating material between the web and the conventional gravure roll. This increases frictional force F between the web and the conventional gravure roll because there is less total coating material supplying lubricating action between the web and the conventional gravure roll. To counteract this increased frictional force F resisting movement of web 11 in the direction of web travel, even greater tension force T must be applied to web 11.

Figure 7A:
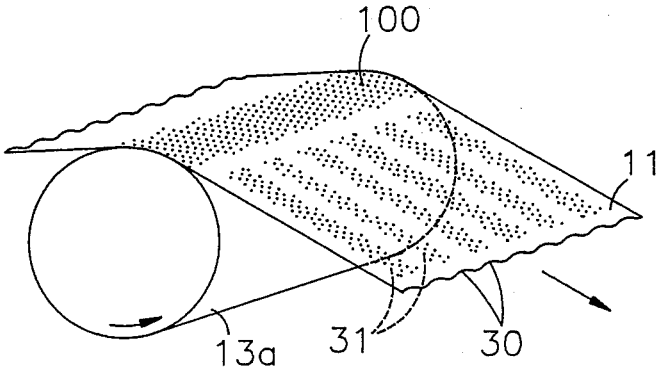

When a high longitudinal tension force T is applied to web 11, a plurality of wrinkles 30 result in web 11, with wrinkles 30 running in the direction of tension force T applied to web 11 as shown in FIG. 7*a*. As a result of wrinkles 30, the region (where web 11 overlaps gravure roll 13*a*) occupied by the thin layer of coating material varies in thickness transversely across web 11; hence thickness of the relatively thin layer of coating material contacting web 11 varies across width of web 11. Consequently, the amount of coating material applied to web 11 varies and the resulting coating applied to the web is uneven across the web. The uneven coating manifests itself as a pattern of longitudinal coating wrinkles 31, alternating between regions 30 on the web having larger amounts of coating material and regions on the web having smaller amounts of coating material when proceeding across web 11; this is illustrated in FIG. 7*a*.

Figure 7B:
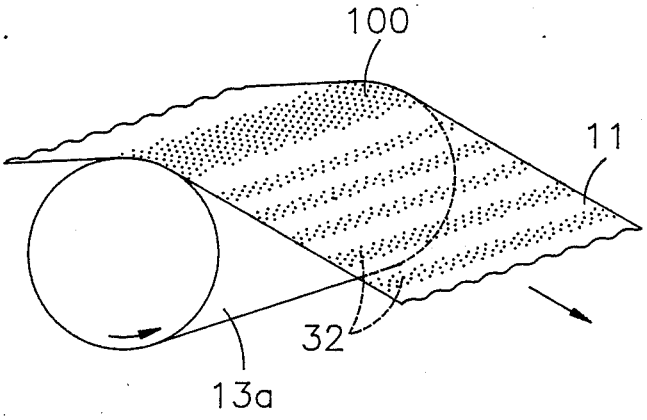

In prior art devices, the large frictional force F between conventional gravure roll 13*a* and web 11 makes it difficult to run web 11 at constant speed; in prior art devices web 11 typically runs at varying speeds, first at a higher speed and then at a lower speed. This results in uneven coating on web 11—lateral or transverse coating material stripes 32 appear, as shown in FIG. 7*b*. These coating material stripes 32 result from alternating presence of larger amounts of coating material and then smaller amounts of coating material in the longitudinal direction along web 11. The large diameter of prior art gravure roll 13*a* also contributes to occurrence of these transverse coating material stripes along the longitudinal direction of web 11.

Using prior art devices, web 11 often leaves a layer of gravure coating material in the wedge-shaped space 41*a* between web 11 and gravure roll 13*a* at the forward or departing position (considering the direction of travel of web 11 with respect to the gravure roll); sometimes this causes lengthwise or longitudinal coating wrinkles on web 11. This occurs because the amount of divergence of web 11 from gravure roll 13*a* in wedge-shaped portion 41*a* is so small, i.e. the wedge is so sharp or slender (due to the large diameter of gravure roll 13*a*), that coating material in space 41*a* is pulled by web 11 along the curved circumferential surface of gravure roll 13*a*. The shear stress between web 11 and the layer of coating material becomes large, lengthwise wrinkles form and the resulting coating is uneven.

Specifically, as web 11 moves, shear stress causes a portion of the coating material between gravure roll 13*a* and web 11 and in wedge-shaped space 41*a* to be pulled or dragged along by web 11, towards the right in FIG. 6*a*. This portion of coating material continues to the right as it is dragged by web 11 and carried by the gravure roll surface. As the web diverges from the gravure roll, more and more coating material is required to fill the region of overlap of the web and the gravure roll and to fill the wedge-shaped space 41*a*. As distance between the web and the gravure rolls get larger and larger in the general area of wedge-shaped space 41*a*, coating material which is relatively farther away from the web is less affected by the shear stress created by movement of the web than is coating material adjacent to the web.

As the portion of coating material dragged by the web reaches a position at which the shear stresses in the coating material are no longer large enough to drag along the central portion of the coating material, remote from the web and generally midway between the web and the gravure roll surface, this central portion of coating material is no longer carried to the right in FIG. 6*a* by the web. Rather, the central portion of the coating material in wedge-shaped space 41*a* breaks away from or lags with respect to the coating material adjacent to the web. As this breaking away or lagging occurs, there is no longer quite as much coating material immediately adjacent to the moving web and a thin spot of coating results on the web.

As the web continues to travel to the right in FIG. 6*a*, a part of the coating material in the central portion of wedge-shaped space 41*a* may adhere to a fresh portion of coating material (which has been applied to the surface of web 11 by the gravure roll) and may move along web 11 with the fresh portion of coating material adjacent to web 11. When this occurs, a relatively thick portion of coating material is applied to web 11; the coating appears as regions of transverse stripes 32 in FIG. 7*b*. In prior art devices, these shortcomings act together to make the gravure coating uneven. Additionally, it is impossible to adjust or to control thickness of the resulting coating using known prior art devices.

In contrast to the prior art, gravure roll 13 of the invention has a small diameter, preferably from about 20 to about 50 millimeters, as shown in FIG. 5. Gravure roll 13 contacts web 11 only over a small area. When gravure roll 13 turns in a direction opposite to the running direction of web 11, frictional force between gravure roll 13 and web 11 is small; the small friction force is denoted f in FIG. 6*b*. Hence, the tension force t required to run web 11 smoothly is small.

The small magnitude of friction force f results in part from the small area of contact between gravure roll 13 and web 11. This results in the normal component of friction force f, which acts towards the center of gravure roll 13 and is denoted by arrow n in FIG. 6*b*, being small.

The low magnitude of normal force component n permits a thin layer of coating material to be maintained at nearly all times between the running web and the gravure roll, so that the underside of web 11 does not directly contact the surface of gravure roll 13 in the region where web 11 overlaps gravure roll 13. The thin layer of coating material between web 11 and gravure roll 13 keeps frictional force f low. Additionally, the low tension force t applied to web 11 contributes to low friction force f between gravure roll 13 and web 11.

Even when web 11 is very thin, on the order of microns for example, practicing the invention does not produce lengthwise wrinkles 30 such as those produced by prior art devices in the web coating. In the invention, because frictional force f and normal force n between web 11 and gravure roll 13 are small and a thin layer of gravure coating material is essentially always maintained between web 11 and gravure roll 13, frictional resistance to running web 11 is quite small; web 11 can be run at a constant velocity much more easily than with the prior art devices.

In the invention, the wedge-shaped spaces 29 and 41 between web 11 and gravure roll 13 are wider than those of prior art devices, due to the small diameter of gravure roll 13. ("Wider" in this context means that for a given distance measured along web 11, the curved surface of gravure roll 13 diverges from web 11 more than does the curved surface of a conventional gravure roll.) These "wider" wedge-shaped spaces 29 and 41 mean that the thin layer of coating material extends along the gravure roll circumferential surface and along web 11 a shorter distance than the distance a corresponding thin layer of gravure coating material extends along the gravure roll circumferential surface and along web 11 when a conventional gravure roll is used. Consequently, there is less opportunity for shear stress (generated in the layer of coating material by the running action of web 11) to drag along portions of coating material located closer to or at the center of the wedge-shaped spaces ("center" refers to the region generally midway between the gravure roll surface and the web) and there is less total shear stress in the portion of coating material defining the thin layer of coating material separating web 11 from the gravure roll.

Additionally, because the gravure roll surface diverges from the web more quickly for a given distance along the gravure roll surface, the central portion of coating material in the wedge-shaped space is farther away from the traveling web and from the gravure roll surface. This portion of coating material is less susceptible to shear stress and hence is less likely to first be dragged along by the web and then break away from the layer of coating material adjacent to the web and hence is less likely to produce a transverse stripe 32 of thicker or thinner coating on the web. Yet additionally, the thickness of the end portion of the thin layer of coating material defined by the coating material in wedge-shaped space 41 is small. This also helps to prevent lengthwise coating wrinkles on web 11.

When the gravure roll is rotated so that its surface contacting the web moves in a direction opposite to that of web travel, this also contributes to the smoothness of the applied coating. The movement of the gravure roll surface in a direction opposite that of the web tends to pull the coating material in wedge-shaped space 41 to the left in FIG. *6b*, minimizing the length of wedge-shaped space 41 between gravure roll 13 and web 11. This pulling effect exerted by the gravure roll surface tends to retain coating material in the thin layer which separates gravure roll 13 and web 11 in the region in which the web overlaps the gravure roll. This action in turn minimizes the tendency for the central portion of coating material (which is the portion of coating material remote from the web and more or less equidistant from the web and the gravure roll) in wedge-shaped space 41 to be carried by shear stresses created in the coating material by movement of web 11, in the direction of travel of web 11. Hence, the tendency of the central portion of the coating material to break away from the coating material adjacent to the web, which is one mechanism by which the transverse wrinkles or stripes 32 of coating material illustrated in FIG. 7 result using prior art devices, is minimized or even eliminated.

These features of the invention keep the layer of gravure coating material between web 11 and gravure roll 13 in a relatively constant state while gravure roll 13 is rotating and web 11 is running and permit even application of coating to web 11. As the coating material defining the thin layer of coating material on gravure roll 13 is contacted by web 11, picked up by web 11 and transported away from coating material reservoir orifice 24 by movement of web 11, additional coating material flows up, out of coating material reservoir orifice 24, and replenishes both the coating material defining the thin layer between the gravure roll and web 11 and the coating material which had occupied wedge-shaped spaces 29 and 41.

The gravure coating material is transferred to web 11 from the coating material layer formed in the areas of overlap of web 11 with gravure roll 13 and in wedge-shaped spaces 29 and 41. This enables the coating material reflecting the engraved pattern on the gravure roll 13 to be transferred to the web so that the engraved pattern can be made to appear on the web as part of the coating in a flat, smooth, even thickness without use of a smoothing mechanism such as a smoothing knife, smoothing roller or similar device.

With the invention, the end of the gravure coating layer on the web forms accurately, parallel with the axis of gravure roll 13, at a position immediately between web 11 and gravure roll 13, as shown in FIG. 8 when the gravure roll and/or the web is/are stopped. This allows accurate positioning of the coating beginning and end on web 11, perpendicular to the running direction of movement of web 11. Thus, the entire coating finish from beginning to end is quite good. Additionally, it has been found, as shown in FIG. 9, that when using the invention, thickness of gravure coating material applied to web 11 can be adjusted merely by changing the circumferential velocity of gravure roll 13 relative to running velocity of web 11.

I claim:

1. Gravure coating apparatus for applying coating material to a first side of a traveling continuous web to produce a smooth unrippled coated surface on said web first side, comprising:

a. means for continuously advancing said web in extended generally linear disposition;

b. a gravure roll having a diameter of from about 20 to about 50 millimeters and an engraved surface pattern with a width sufficient to contact the entire width of said continuous web, said roll being positioned for tangentially applying said coating to the entire width of the first side of said continuous web while said continuous web is generally linear and tangent to said gravure roll, with gravure roll-web contact providing sole contact with said web proximate said gravure roll;

c. means for providing said coating material to said gravure roll; and d. means for controlling the amount of coating material on said gravure roll prior to transfer of said coating material from said gravure roll to said traveling continuous web via gravure roll-web contact.

2. Apparatus of claim 1 further comprising means for rotating said gravure roll in a direction so that gravure roll surface and said web move in opposite directions where gravure roll-web contact occurs.

3. Gravure coating apparatus for applying coating material to a first side of a traveling continuous web to produce a smooth unrippled coated surface on said web, comprising:

a. means for advancing said continuous web in extended generally linear disposition through a region in which said coating is applied to said web first side;

b. a gravure roll having a diameter of about 20 millimeters and an engraved surface pattern with a width sufficient to contact the entire width of said web, said roll being positioned within said region;

c. said gravure roll rotating about an axis transverse to the direction of travel of said web;

d. said gravure roll rotating in a direction so that said gravure roll engraved surface contacting said web moves opposite to the direction of travel of said web, for tangentially applying said coating material to the first side of said web while said web is in extended generally linear disposition and tangent to said gravure roll, said coating material being applied to said first side of said web only in an amount to produce a smooth coating of uniform thickness along the longitudinal length of said web;

e. said coating material being applied to produce a pattern on said web corresponding to engraving on said gravure roll, gravure roll-web contact being the sole contact with said web proximate said gravure roll;

f. means for providing said coating material to said gravure roll; and g. means for wiping excess coating material from said gravure roll prior to transfer of said coating material to said web via gravure roll-web contact and leaving coating material on said roll in an amount to produce a smooth coating of uniform thickness along the longitudinal length of said web without subsequent contact therewith for coating smoothing or coating thickness regulation, after said gravure roll has applied said coating material to said web.

4. A gravure coating device for applying a smooth coating in a selected pattern to a first side of a traveling continuous web, comprising:

a. means including spaced apart extension rolls contacting a second side of said web, for advancing said web in generally straight disposition past a coating station defined by an engraved gravure roll between said extension rolls;

b. said gravure roll having an engraved surface portion with a width sufficient to produce said pattern along the entire width of said web, having diameter of about 20 millimeters and being positioned to tangentially contact said first side of said web at said coating station, while rotating in a direction opposite to said web at gravure roll-web contact, without substantially deflecting said web;

c. means for providing said coating material to said gravure roll;

d. means for wiping excess coating material from said gravure roll prior to gravure roll-web contact as said gravure roll rotates so that coating material remaining on said gravure roll upon contact with said web is a proper amount to produce a smooth coating of uniform thickness corresponding to said pattern of engraving of said gravure roll along the width and length of said web without subsequent coating smoothing or other coating thickness regulating contact of said coated web after gravure roll-web contact;

e. said second side of side web at and proximate said gravure roll being unrestrained;

f. said first side of said web being uncontacted for coating control purposes after contact with said gravure roll.

5. A method for regulating the thickness of application of a gravure coating to a moving web comprising:

a. applying a gravure coating material to a surface pattern on a rotatable gravure roll having a diameter of from about 20 to about 50 mm;

b. rotating said gravure roll about an axis transverse the direction of movement of said web;

c. wiping excess coating material from said gravure roll prior to transfer of said coating material to said web via gravure roll-web contact and leaving coating on said roll in an amount to produce a smooth coating of uniform thickness along the longitudinal length of said web without contact therewith for coating smoothing or coating thickness regulation, after said gravure roll has applied said coating material to said web;

d. tangentially contacting said moving web with said gravure roll at a position at which said web is unrestrained, with said gravure roll rotating about said axis; and gravure roll surface pattern contacting the entire width of said web moving in a direction opposite that of travel of said web;

e. adjusting gravure roll rotation speed and web movement speed until a desired thickness of coating results on said web.

6. The method of claim 5 wherein adjusting gravure roll rotation speed and web movement speed until a desired thickness of coating results in said web results, further comprises:

increasing coating thickness by increasing the ratio of gravure roll circumferential velocity to web running velocity if said ratio is less than 2.0 but by decreasing the ratio of gravure roll circumferential velocity to web running velocity if said ratio is greater than 2.0, if said coating thickness is less than said desired coating thickness.

7. The method of claim 5 wherein adjusting gravure roll rotation speed and web movement speed until a desired thickness of coating results in said web results, further comprises:

decreasing coating thickness by decreasing the ratio of gravure roll circumferential velocity to web running velocity if said ratio is less than 2.0 but by increasing the ratio of gravure roll circumferential velocity to web running velocity if said ratio is greater than 2.0, if said coating thickness is greater than said desired coating thickness.

8. Gravure coating apparatus for applying coating material to a first side of a traveling continuous web to produce a smooth unrippled coated surface on said web first side, comprising:

a. means for continuously advancing said web in extended generally linear disposition;

b. a gravure roll having a diameter of from about 20 to about 50 millimeters and an engraved surface pattern positioned for tangentially applying said coating to the first side of said continuous web while said continuous web is generally linear and tangent to said gravure roll, with gravure roll-web contact providing sole contact with said web proximate said gravure roll;

c. means for providing said coating material to said gravure roll;

d. means for controlling the amount of coating material on said gravure roll prior to transfer of said coating material from said gravure roll to said traveling continuous web via gravure roll-web contact; and e. means for adjustably varying the speed of rotation of said gravure roll to produce a relative velocity difference between said web and said gravure roll, the rotational velocity of said gravure roll at the surface of said gravure roll being faster than the running velocity of said web to control the smoothness of coating applied to said web.

9. The apparatus defined in claim 8 wherein said rotational velocity of said surface of said gravure roll is twice the running velocity of said web.

10. A method for regulating the thickness and smoothness of application of a gravure coating to a moving web comprising:

a. applying a gravure coating material to a surface pattern on a rotatable gravure roll having a diameter of from about 20 to about 50 millimeters;

b. rotating said gravure roll about an axis transverse the direction of movement of said web;

c. wiping excess coating material from said gravure roll prior to transfer of said coating material to said web via gravure roll-web contact and leaving coating on said roll in an amount to produce a smooth coating of uniform thickness along the longitudinal length of said web without contact therewith for coating smoothing or coating thickness regulation, after said gravure roll has applied said coating material to said web;

d. tangentially contacting said moving web with said gravure roll at a position at which said web is unrestrained, with said gravure roll rotating about said axis, and gravure roll surface contacting said web moving in a direction opposite that of travel of said web; and e. adjustably varying gravure roll rotation speed to produce a relative velocity difference between said web and said gravure roll, the rotational velocity of said gravure roll at the surface of said gravure roll being faster than the running velocity of said web to control the smoothness of coating applied to said web.

11. The method defined in claim 10 wherein said rotational velocity of said surface of said gravure roll is twice the running velocity of said web.

12. Gravure coating apparatus for applying coating material to a first side of a traveling continuous web to produce a smooth unrippled surface coating of selected thickness on said web first side, comprising:

a. means for continuously advancing said web in extended generally linear disposition;

b. a gravure roll having a diameter of from about 20 to about 50 millimeters and an engraved surface pattern positioned for tangentially applying said coating to the first side of said continuous web while said continuous web is generally linear and tangent to said gravure roll, with gravure roll-web contact providing sole contact with said web proximate said gravure roll;

c. means for providing said coating material to said gravure roll;

d. means for controlling amount of coating material on said gravure roll prior to transfer of coating material from said gravure roll to said traveling continuous web via gravure roll-web contact; and e. means for varying speed of rotation of said gravure roll to maintain a selected relative velocity between said web and said gravure roll corresponding to said selected coating thickness by increasing speed of said gravure roll when said relative velocity is less than said selected relative velocity and decreasing speed of said gravure roll when said relative velocity is greater than said selected relative velocity.

13. Gravure coating apparatus for applying coating material to a first side of a traveling continuous web to produce a smooth unrippled surface coating of relative maximum thickness on said web first side, comprising:

a. means for continuously advancing said web in extended generally linear disposition;

b. a gravure roll having a diameter of from about 20 to about 50 millimeters and an engraved surface pattern positioned for tangentially applying said coating to the first side of said continuous web while said continuous web is generally linear and tangent to said gravure roll, with gravure roll-web contact providing sole contact with said web proximate said gravure roll;

c. means for providing said coating material to said gravure roll; and d. means for varying speed of rotation of said gravure roll to maintain relative velocity between said web and said gravure roll at about 2.0 by increasing speed of said gravure roll when said relative velocity is less than 2.0 and decreasing speed of said gravure roll when said relative velocity is greater than 2.0.

14. A method for applying coating material to a first side of a traveling continuous web to produce a smooth unrippled surface coating of selected thickness on said web first side, comprising:

a. advancing said web in extended generally linear disposition past a gravure roll having a diameter of from about 20 to about 50 millimeters and an engraved surface pattern;

b. tangentially contacting said first side of said web with said gravure roll engraved surface pattern while said continuous web is generally linear and tangent to said gravure roll, with gravure roll-web contact providing sole contact with said web proximate said gravure roll;

c. providing said coating material to said gravure roll while controlling amount of coating material on said gravure roll prior to transfer of coating material from said gravure roll to said traveling continuous web via gravure roll-web contact; and d. varying speed of rotation of said gravure roll to maintain a selected relative velocity between said web and said gravure roll corresponding to said selected coating thickness by increasing speed of said gravure roll when said relative velocity is less than said selected relative velocity and decreasing speed of said gravure roll when said relative velocity is greater than said selected relative velocity.

15. A method for applying coating material to a traveling continuous web to produce a smooth unrippled surface coating of relative maximum thickness on a web first side, comprising:

a. advancing said web in extended generally linear disposition past a gravure roll having a diameter of from about 20 to about 50 millimeters and an engraved surface pattern;

b. tangentially contacting said first side of said web with said gravure roll engraved surface pattern while said continuous web is generally linear and tangent to said gravure roll, with gravure roll-web contact providing sole contact with said web proximate said gravure roll;

c. providing said coating material to said gravure roll while controlling amount of coating material on said gravure roll prior to transfer of coating material from said gravure roll to said traveling continuous web via gravure roll-web contact; and d. varying speed of rotation of said gravure roll to maintain relative velocity between said web and said gravure roll at about 2.0 by increasing speed of said gravure roll when said relative velocity is less than 2.0 and decreasing speed of said gravure roll when said relative velocity is greater than 2.0.

* * * * *